United States Patent [19]

Sundet

[11] 4,430,851

[45] Feb. 14, 1984

[54] TWISTED CERAMIC FIBER SEWING THREAD

[75] Inventor: Douglas C. Sundet, Hudson, Wis.

[73] Assignee: Minnesota Mining and Manufacturing Company, St. Paul, Minn.

[21] Appl. No.: 344,053

[22] Filed: Jan. 29, 1982

[51] Int. Cl.[3] ..... D02G 3/04; D02G 3/02; D02G 3/16

[52] U.S. Cl. ..... 57/211; 57/236; 57/243

[58] Field of Search ..... 57/210, 211, 229, 236, 57/238, 240, 244, 249, 243

[56] References Cited

U.S. PATENT DOCUMENTS

| | | | |
|---|---|---|---|
| 2,424,743 | 7/1947 | Davis | 57/229 X |
| 3,410,078 | 11/1968 | Freedman et al. | 57/211 |
| 3,709,706 | 1/1973 | Sowman | 106/57 |
| 3,729,920 | 5/1973 | Sayers et al. | 57/229 X |
| 3,758,704 | 9/1973 | Naud | 174/102 |
| 3,793,041 | 2/1974 | Sowman | 106/57 |
| 3,795,524 | 3/1974 | Sowman | 106/65 |
| 3,835,637 | 9/1974 | Russel | 57/249 |
| 3,858,636 | 1/1975 | Kibler | 152/330 |
| 3,909,278 | 9/1975 | Johnson | 106/65 |
| 3,913,309 | 10/1975 | Chiarotto | 57/229 |
| 4,047,965 | 9/1977 | Karst et al. | 106/65 |
| 4,123,073 | 10/1978 | Cremerius | 277/299 |
| 4,125,406 | 11/1978 | Sowman | 106/57 |
| 4,166,147 | 8/1979 | Lange et al. | 428/328 |
| 4,304,811 | 12/1981 | David et al. | 57/238 X |

OTHER PUBLICATIONS

3M Bulletin N-MHFOL(79.5)MP.
3M Bulletin N-MPBFC-2(190.5)11.
3M Bulletin N-MPBVF-1(89.5)11.
3M Bulletin N-MTDS(79.5)MP.
3M Bulletin N-MPBBS-(89.5)11.
3M Bulletin N-MOUT(89.4)MP.

*Primary Examiner*—Donald Watkins
*Attorney, Agent, or Firm*—Donald M. Sell; James A. Smith; Lorraine R. Sherman

[57] ABSTRACT

A twisted sewing thread comprising at least two strands made of ceramic fibers at least one of which strands is served with organic or inorganic fibers, the strands being individually twisted or two or more strands twisted together in one direction and then an assembly of the resulting twisted strands plied with other like or different twisted strands in the opposite direction to produce the ceramic fiber sewing thread.

30 Claims, 3 Drawing Figures

TWISTED CERAMIC FIBER SEWING THREAD

DESCRIPTION

1. Technical Field

This invention relates to a sewing thread of ceramic fibers, the thread being suitable for very high temperature applications. In another aspect, it relates to a process for making a thread of ceramic fiber. In a further aspect, it relates to ceramic fabric articles sewn with the thread.

2. Background Art

Conventional twisted sewing thread constructions known in the art customarily are of organic fibers and have lower use temperatures than the ceramic fiber fabrics available. Such thread, when used to sew ceramic fiber articles which are then subjected to high temperature, rapidly deteriorates. The result is failure of the stitching.

The patent art teaches many examples of non-ceramic twisted and plied structures, and many with modifications to achieve a specific characteristic. U.S. Pat. No. 3,758,704 teaches twisted and plied strands of a wire rope around an insulated conductor core. U.S. Pat. No. 4,123,073 teaches a sealing bead for use in sealing gaps in installation and machines comprising a plurality of folded strips of paper which are twisted together into a bundle of helical strips bound together by a helically wound thread. U.S. Pat. 3,858,636 relates to treated polycarbonamide tire cord, the cord comprising a plurality of individual filaments twisted and plied together.

Ceramic fibers have provided commerce with a new family of fabrics or textiles which have a high tensile strength and high modulus of elasticity and the ability to maintain these properties at elevated temperatures. Prior art conventional twisted threads, however, lack the high temperature resistance desired in many applications. Many have organic fiber components which burn out at temperatures above 300° C., resulting in disintegration of the fiber component and failure of the sewn article for its intended use. One type of commercial thread, i.e., Astroquartz® Q-18, fused silica, twisted sewing thread begins to deteriorate at temperatures in the range of 500° to 800° C. When this thread is used to sew fabrics made, for example, of alumina-boria-silica fibers with an alumina-boria-silica ratio of 9:2 to 3:1.5, disclosed in U.S. Pat. No. 3,795,524 and sold under the trademark Nextel® 312, or alumina-silica fibers having an alumina to silica ratio of 3:2, disclosed in U.S. Pat. No. 4,047,965, which are high temperature resistant up to at least 1400° C., the heat causes failure of the thread and the subsequent deterioration of the stitching. A property of ceramic fibers, however, is their somewhat brittle nature, that is, the tendency of the fibers to fracture under acute angle bends (e.g., as are present when sewing machine needles are used). When machine sewing thread made of ceramic fibers and twisted in the conventional manner is subjected to short radius stress, such as encountered in the sewing needle of machines or in the tying of knots, the ceramic fiber sewing thread twisted in the conventional manner is prone to breakage. Due to this problem, tedious and labor intensive handsewing has been employed to fabricate articles made from ceramic fiber fabrics or cloths that need to be sewn or tied with ceramic fiber sewing thread.

As an alternative to handsewing, newly developed high temperature (i.e., greater than 1000° C.) insulating fabrics are being machine-sewn with a composite ceramic fiber sewing thread having a ceramic fiber core strand, a sacrificial organic core strand, and a tubular body of 8 braided strands of continuous Nextel 312 alumina-boria-silica fibers, each braided strand being double-served with 50 denier rayon yarn, the thread having a diameter of 0.039 in (about 0.1 cm). This composite ceramic fiber machine sewing thread is described in 3M Bulletin N-MST (Apr. 20, 1980) under the trademark Nextel MST-39. Although this composite thread has provided a means of machine sewing fabrics to be used at temperatures above 1000° C., the braided structure has a larger diameter than many sewing threads and requires the use of sewing machine needles that have eyes of larger size than is generally used on commercial sewing machines. This composite thread is also more costly to manufacture than twisted threads. These disadvantages have limited the use of the composite thread.

DISCLOSURE OF INVENTION

Briefly, the present invention provides a ceramic fiber sewing thread having one or more (preferably two to twelve) strands of continuous ceramic fibers which preferably comprise ceramic metal oxide, at least one of which strands is served with organic or inorganic fiber yarn, the strands being individually twisted or two or more strands twisted together in one direction, the twisted strand(s) being optionally served again, and preferably an assembly of the resulting twisted strands being plied with like or different strands in the opposite direction, to form a machine sewing thread useful, for example, in sewing ceramic fabric to form such articles as insulation blankets.

As used in this application to describe the present invention:

- "fiber" means a threadlike filament structure having a length at least 100 times its diameter;
- "blends of fibers" means combinations of two or more different fibers;
- "continuous fiber" means a fiber which has infinite length compared to its diameter, as described in U.S. Pat. No. 4,047,965;
- "flexible" thread means a thread capable of being bent in a sharp angle (such as occurs when a thread is being pulled through a reciprocating needle) without fracturing, and having the ability to be tied into a closed overhand knot without fracturing;
- "fracture" means to break, split, or crack;
- "heat fugitive" means volatilizes, burns, or decomposes upon heating;
- "ply" means to aggregate two or more twisted strands by twisting together;
- "modulus" means modulus of elasticity;
- "serving" means wrapping a yarn such as rayon around a strand for protection of the strand against fracture and abrasion;
- "strand" means a plurality of aligned, aggregated fibers;
- "thread" means one or more strands, at least one of which is twisted and served;
- "twist" means to rotate one or more strands on a longitudinal axis;
- "yarn" means one strand or a plurality of strands which can be twisted or untwisted;
- "non-vitreous" material is one that is not derived from a melt; and "ceramic metal oxides" means metal oxides which can be fired into a rigid or self-supporting polycrystalline form and are stable in a normal air environment, e.g., 23° C. and 50 percent relative humidity.

In the sewing thread of this invention, each strand may be of the same or different continuous ceramic fibers, or a blend of two or more kinds of continuous ceramic fibers. The untwisted ceramic fiber strands comprise inorganic fibers such as Astroquartz continuous fused silica fibers or non-vitreous fibers such as graphite fiber, Nicalon® silicon carbide fiber (Nippon Carbon, Ltd., Japan) or fibers of ceramic metal oxide(s) (which can be combined with non-metal oxides, e.g., $SiO_2$) such as thoria-silica-metal (III) oxide fibers (see U.S. Pat. No. 3,909,278), zirconia-silica fibers (see U.S. Pat. Nos. 3,793,041 and 3,709,706), alumina-silica fiber (see U.S. Pat. No. 4,047,965), alumina-chromia-metal (IV) oxide fiber (see U.S. Pat. No. 4,125,406), and titania fibers (see U.S. Pat. No. 4,166,147).

The sewing thread of the present invention, which preferably has only 75% the diameter of the alternate machine sewable composite Nextel MST-39 ceramic fiber thread, is flexible, thus not susceptible to fracture and unraveling under the stress inflicted by machine sewing and which would result in weak or broken stitches. As such, the thread of the present invention eliminates the need for laborious handsewing. In addition, the integrity of the stitches sewn with the thread of the present invention is maintained at very high temperatures, i.e., up to 1430° C. when alumina-boria-silica fibers, e.g., Nextel 312, are used. Also, the thread is virtually resistant to shrinkage, abrasion, and to moisture, and is chemically inert. The somewhat brittle ceramic fibers are provided in a served yarn which is twisted and plied to form the thread. The serving yarn protects the fibers in sharp bend stresses during the machine sewing process and gives the sewing thread more fracture resistance. The power sewing machine process may require any portion of thread to pass through the eye of a sewing machine needle rapidly up to 80 times without fracturing. The serving can be wrapped either in both directions or only one direction or it can be braided. The preferred method is to wrap the serving material in the same direction as in the first twisting operation. The thread of this invention, which has a relatively small diameter, e.g., in the range of 0.010 inch to 0.035 inch (0.025 mm to 0.9 mm), preferably about 0.029 inch (0.74 mm), is better suited for certain machine sewing applications where a smaller diameter, high temperature thread is needed.

A general process that can be used for making sewing thread by this invention comprises: (1) an untwisted strand of 400 to 900 denier ceramic fibers having 130 to 500 filaments is sized with a lubricant, e.g. a blend of polyethylenimine and Carbowax® 600 polyethyleneglycol wax or polytetrafluoroethylene to facilitate the thread production process (the sizing can be removed in a heat cleaning operation at temperatures of 300° C. and above); (2) the sized strand is then served (wrapped) with a low denier yarn, such as rayon; (3) the served strand is twisted or it may be aggregated with at least one other like or different ceramic fiber strand which are twisted together in one direction; (4) the twisted strands are optionally served again; (5) an assembly of the twisted strands are then plied in the opposite direction with other like or different sized twisted strands to produce a thread; (6) the thread is optionally served as a whole on its exterior; and (7) the thread is coated with a finish, e.g., a blend of Airflex® vinyl acetate-ethylene copolymer emulsion with polytetrafluoroethylene emulsion, to lubricate the thread and protect it against abrasion during machine sewing. The coating can be applied by passing the yarn through a dip tank and drying the coating solution on the yarn.

DETAILED DESCRIPTION

Figure 1:
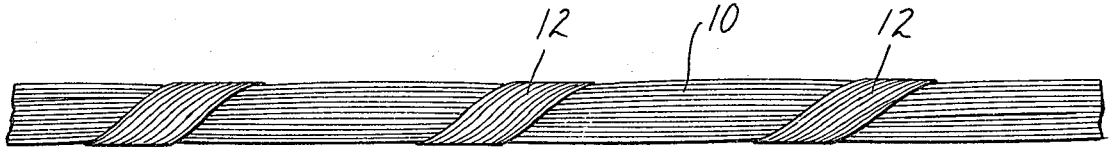
FIG. 1 is an enlarged elevational view of a single served strand useful in making the thread of this invention.
Figure 2:
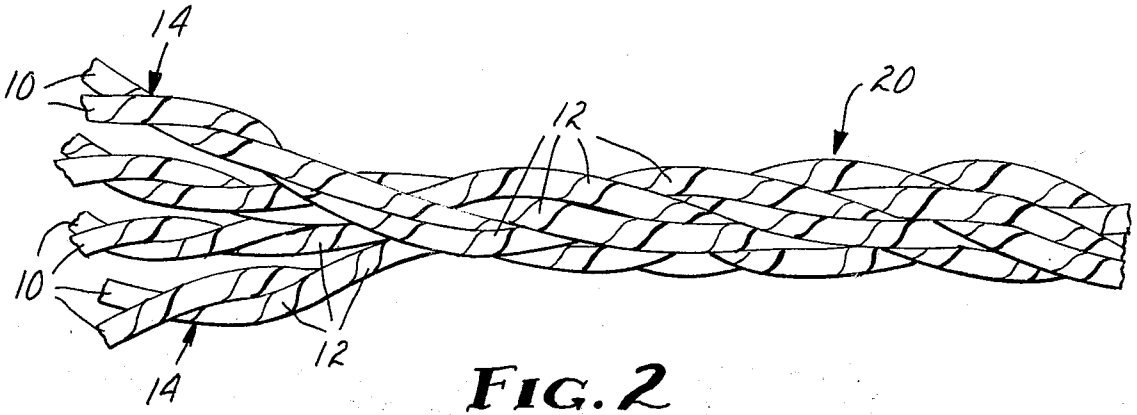
FIG. 2 is an enlarged elevational view of one embodiment of the sewing thread of this invention having 8 individually served strands.

Referring to FIGS. 1 and 2, one embodiment 20 of the sewing thread of the present invention is shown. Individual strands 10, e.g. of continuous 600 denier Nextel 312 fibers (with sizing) having about 390 fibers per strand, are served with yarn 12, e.g. 50 denier rayon having about 30 to 35 fibers per strand, in the S direction, e.g. at 18 to 20 wraps per inch (7 to 8 wraps per cm). The served strand 10 is then twisted with one other such strand in the S direction, e.g. at 5.8 twists per inch (2.3 twists per cm), to form yarn 14. Next, four of these yarns 14 are plied together in the Z direction, e.g. at 5.2 twists per inch (2.05 twists per cm), to form a plied yarn 20 (having, as shown in the drawing, a total of eight served strands). This thread has a 2/4 construction. (As customarily understood, a serving is in the Z direction if, when the yarn is held in a vertical position, the visible spirals conform in direction of slope to the central portion of the letter "Z"; a serving is in the S direction if, when the yarn is held in a vertical position, the visible spirals conform in direction of slope to the central portion of the letter "S".)

Figure 3:
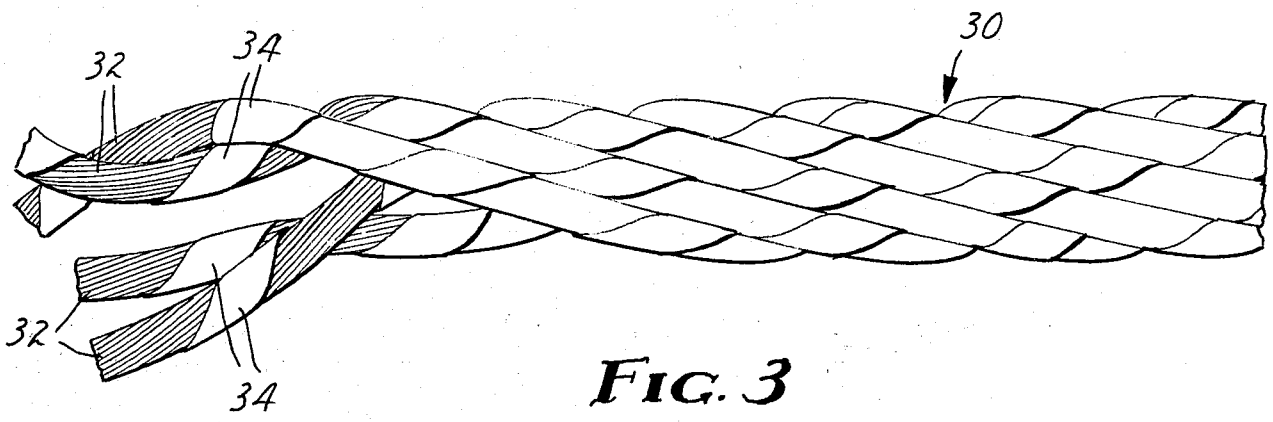
FIG. 3 is an enlarged elevational view of another embodiment of the sewing thread of this invention having 4 individually served strands, the left-hand portion showing the fibers in the strand.

FIG. 3 shows a second embodiment 30 of the present invention. Individual strands 32, e.g. of continuous 600 denier Nextel 312 fibers (with sizing) are served with yarn 34, e.g. 50 denier rayon in the S direction, e.g. at 18 to 20 wraps per inch (7 to 8 wraps per cm). The served strand is then twisted in the S direction, e.g. at 5.8 twists per inch (2.28 twists per cm). Served and twisted strand 32 is then plied with three other such strands in the Z direction, e.g. at 5.8 twists per inch (2.28 twists per cm) to form thread 30 (having, as shown in the drawing, a total of four served strands). This thread has a ¼ construction and is represented by sample 11 in TABLE I below.

Preferably, the serving yarn is made of continuous organic fibers, such as twisted or untwisted rayon, polyester, polyamide, elastomeric, or cotton, but most preferably it is a 30 to 300 denier yarn (typically a 50 denier rayon). Inorganic serving materials such as refractory wire and fused silica fibers may be used. Materials such as common E-glass fibers (a vitreous product) are not preferred as a serving material because of their low melting point and subsequent possible fluxing effects on the non-vitreous ceramic fibers. The generally brittle property of ceramic fibers makes them less useful as serving yarns. A serving machine is used to apply the serving yarn to the ceramic fiber strand or strands, although any device which provides covering to the ceramic strands, as by wrapping or braiding the serving material around the yarn, could be used, such as a braiding machine. The serving can be wrapped on the strand in a number of different ways, i.e. the serving can be wrapped around the strand in both directions (double-served), or it can be wrapped around the strand in one direction only (single served). Also the number of wraps per unit of length can be varied. Particularly useful are 5 to 30 wraps per inch (2 to 12 wraps per cm). After the ceramic fiber strand is served, it can be aggregated with at least one other ceramic fiber strand, the aggregate then twisted and plied on a twisting machine with like or different twisted strands or twisted aggregates. Threads with different yarn constructions and twist levels can be made in various combinations, e.g., a rayon-served strand of Nextel 312 fibers was twisted with an unserved strand of Astroquartz fused silica fibers, after which four such twisted strands were plied into an eight-strand thread.

The purpose of the serving is three-fold. First, the serving reinforces and protects the yarn during the twisting operation. Secondly, the serving strengthens the thread and protects the ceramic strands against sharp bend stresses and abrasion during machine sewing. Thirdly, sewing enhances seam strength until the fabric is heated high enough to burn off the serving material.

The serving, when made of organic fibers, is heat fugitive, i.e., the organic fibers are volatilized or burned away when the sewn article is exposed to a high temperature (e.g. 300° C. or higher). The remaining ceramic structure maintains its integrity as stitches in the sewn article. The thread loses part of its strength after it is heated for prolonged periods at temperatures up to 1150° C. or higher and for short periods at temperatures up to 1500° C. or higher depending on the particular ceramic fibers used, but its residual strength and flexibility is superior to that of other nonbraided threads known in the art which deteriorate at 500° to 800° C., and its tensile stength and modulus are sufficient for its intended use in maintaining the integrity of the stitches.

Construction designation (e.g., 1/0, ½, 2/2, 2/4) in threads is defined in ASTM D 578-61. The first digit indicates the number of basic strands twisted together to form twisted strands. The second digit, which is separated from the first digit by a diagonal line, indicates the number of twisted strands which are plied together. The total number of basic strands in a plied assembly is the product of the two digits (zero is multiplied as one). A 2/4 plied yarn has 8 basic strands.

A preferred strand is made of continuous alumina-boria-silica ceramic fibers having an alumina:boria mol ratio of 9:2 to 3:1.5 and containing up to 65 weight percent silica, more preferably 20 to 50 weight percent silica, as described in U.S. Pat. No. 3,795,524. Nextel 312 alumina-boria-silica ceramic fiber can be commercially obtained as a roving (untwisted strand) and is described in 3M bulletins, e.g., N-MHFOL(79.5)MP, N-MPBFC-2(109.5)11, N-MPBVF-1(89.5)11, N-MTDS(79.5)MP, N-MPBBS-(89.5)11, and N-MOUT(89.4)MP. The Nextel 312 ceramic fiber strands may have 25 to 1000 continuous fibers each and are 50 to 1800 denier.

The diameters of sewing threads of the present invention having 3 to 10 twists per inch (1.2 to 4.0 twists per cm) generally range from 0.010 inch (0.025 mm) for ½ construction to 0.035 inch (0.9 mm) for ¾ construction. A preferred diameter when 600 denier, Nextel 312 ceramic fiber strands, having 6 twists per inch (2.4 twists per cm) is used, is 0.029 inch (0.74 mm) for 2/4 sewing machine thread.

The sewing thread of the present invention is useful in any machine or handsewing or support tying application where thread having tensile strength, abrasion resistance, and flexibility is required at temperatures up to 1150° C. for extended terms and up to 1430° C. for short terms, strands of Nextel ® 312 fibers being especially useful. The thread has utility, for example, in the fabrication of furnace curtains and vacuum furnace linings, insulation for heating elements, sleevings, hose coverings and tapes, and in thermal barriers for aerospace applications. The thread is useful to sew together ceramic fiber batting or insulation for insulating furnaces or other heat processing equipment, especially combinations of ceramic fiber fabrics and ceramic fiber batting or other sewable articles. The thread is also useful in sewing braided gaskets and baghouse filters.

As a specific example, the thread is useful to make quilted blanket insulation. The quilted blanket is of a sandwich-like construction made up of two pieces of ceramic fabric (which can be made of Nextel ceramic fibers) enveloping a layer of bulk insulating staple ceramic fibers, such as Kaowool ® staple ceramic fibers (Babcock & Wilcox Co.). The fabric and insulating fibers are retained in place by stitching the construction along its periphery and its interior area in any desired pattern using the thread of the present invention.

Variations of the threads described, as to construction and fiber content, are clearly envisioned within the scope of this invention. All threads comprise at least one twisted strand of continuous ceramic fibers, said twisted fibers being served with an inorganic or organic yarn. Objects and advantages of this invention are further illustrated by the following examples, but the particular materials, amounts and blends thereof recited in these examples, as well as other conditions and details, should not be construed to unduly limit this invention.

EXAMPLES

A sewing thread with double-served yarn was made as follows. Yarn, of 600 denier Nextel 312 ceramic fibers, having nominally 390 filaments per strand, was served in both the S and Z directions with 50 denier rayon on a No. 4090 H. H. Arnold serving machine. The number of wraps per cm was between 3 and 4. The amount of rayon serving used was about 16.5 percent of the weight of yarn. The served yarn was then twisted and plied on a Fletcher 26-station twister to produce a 2/4 5.8Z TPI (twists per inch) [2.28 TPC (twists per cm)] yarn. The first twisting operation (called first-trip twisting) involved twisting four sets of two single yarns in each set in the S direction at 5.8 TPI (2.28 TPC). Next, the four first-trip twisted yarns were plied together in the Z direction at 5.8 TPI (2.28 TPC). The twisted and plied yarn was then dip coated in an organic polymer finish and dried. The finish used was a blend of Airflex ethylene-vinyl acetate copolymer emulsion and polytetrafluoroethylene emulsion. This sewing thread is designated Sample 2 hereafter.

Other samples were made using the same procedure used in making Sample 2 but varying the fiber composition, serving materials, number of wraps per unit length, and the twist and ply constructions of the threads. Descriptions of the thread samples are summarized in TABLE I, including samples 2 through 12 within the present invention. Samples 13 and 14 which are two commercial sewing threads, i.e., twisted Astroquartz Q-18 and Nextel MST-39 composite ceramic fiber sewing thread of braided construction, were included for purposes of comparison. Sample 3, which is similar to sample 2 except that the individual strands are single served and the serving yarn makes a greater number of wraps per cm, is illustrated in FIGS. 1 and 2.

The above-described thread samples were evaluated to determine diameter [according to ASTM D 578-61, section 14, except that $\frac{3}{8}$ in. (0.95 cm) diameter pressure foot at 2 psi (0.14 kg/cm$^2$) pressure was used], breaking strength (ASTM D 2256-69), knot strength (ASTM D 2256-69), and abrasion resistance (see TABLE II).

Abrasion resistance of the thread samples was measued using a Duplan Cohesion Tester (manufactured by Geier & Bluhm, Inc.). The machine was run for 40 cycles. The samples were removed from the Cohesion Tester and heated to 800° C. for 10 minutes to remove the original fiber sizing and any serving materials. Then the thread samples were compared for breaking strength. The purpose of this evaluation was to determine which samples retained the greatest amount of strength after being subjected to an abrading action.

The thread samples were also evaluated for sewability (i.e. ease of sewing and seam integrity) by sewing a quilted blanket which was made of two layers of fabric of Nextel® 312 ceramic fiber [a harness-satin weave fabric made from Nextel ceramic fibers having a fabric weight of 12 oz/yd$^2$ (407 g/m$^2$) and a thickness of 0.026 inches (0.066 cm)] on each side with a $\frac{1}{2}$ inch (1.25 cm) mat of Fiberfrax fibers (Carborundum Corp.) disposed between the two layers of fabric. A Juki American Commercial sewing machine was used for the test. The ease of sewing was evaluated by estimating the machine speed at which thread samples broke while sewing the blanket. The stitching was started very slowly and the speed gradually increased until the thread broke. The sewability test data are shown in TABLE III. It can be seen that the sample which sewed the best was Sample 3. Sample 2, which gave results comparable to Sample 3, did not sew nearly as well. Sample 1, without rayon serving, sewed poorly. The data in TABLE IV indicate that the threads of the present invention and seam breaking strengths after heat treatment that were considerably higher than those of comparison threads.

Samples for seam strength evaluation were made by overlapping two pieces of 4 inch (10.2 cm) wide style A fabric [a double layer fabric made from Nextel 312 ceramic fibers having a fabric weight of 29 oz/yd$^2$ (984 g/m$^2$) and a thickness of 0.058 inches (0.147 cm)] and running one seam across them. The samples were heated to different temperatures and tested according to ASTM D 1683-68 for seam breaking strength. The results are shown in TABLE IV. Results of the seam breaking strength test show the excellent refractoriness of the threads of the present invention made from Nextel 312 ceramic fiber.

The data in TABLES I, II, III, and IV show that several factors significantly affect the degree of usefulness of the served/twisted sewing thread. Serving method, thread diameter, and level of twist are important factors. The data show that the diameter of the final sewing thread (which is a function of the number of strands) greatly affects the strength properties, especially as they relate to strength in the bent state. For example, increasing the total number of strands from six to eight produces a knot strength which is more than two times greater. The amount of twist is also an important factor in providing a machine sewing thread. It is important that the thread be firm and does not loosen or flatten out when bent, as when it is pushed by the needle through the fabric. It is important that the twist is high enough to give the thread a round, even cross-section. The uniformity in diameter is important to preclude high spots on the thread which may become damaged when passing through a tensioning device or the sewing needle.

TABLE I

THREAD DESCRIPTION

| Sample | Yarn | Construction designation | Twist Per cm | Serving[d] | Serving[f] | Wrap per cm |
|---|---|---|---|---|---|---|
| 1 | 600/312[a] | 2/4 | 2.28Z | NONE | — | — |
| 2 | 600/312 | 2/4 | 2.28Z | 50 rayon | D | 3 to 4 |
| 3 | 600/312 | 2/4 | 2.28Z | 50 rayon | S | 7 to 8 |
| 4 | 600/312 | 2/3 | 2.28Z | 50 rayon | D | 3 to 4 |
| 5 | 600/312 | 2/4 | 2.28Z | 50 rayon | S | 3 to 4 |
| 6 | 600/312 | 2/4 | 2.28S | 50 rayon | D | 3 to 4 |
| 7 | 600/312 | 2/4 | 2.28Z | 40 nylon | S | 3 to 4 |
| 8 | 600/312 | 2/4 | 1.57Z | 50 rayon | D | 3 to 4 |
| 9 | 17-B[b] | 2/4 | 2.28Z | 50 rayon | D | 3 to 4 |
| 10 | Z-11[c] | 2/4 | 2.28Z | 50 rayon | D | 3 to 4 |
| 11 | 600/312 | 1/4 | 2.28Z | 50 rayon | S | 3 to 4 |
| 12 | 600/312 | 2/4 | 2.28Z | 50 rayon[e] | — | — |
| 13 | Q18[g] | 2/3 | 2.36Z | — | — | — |
| 14 | MST-39[h] | — | — | 50 rayon | D | 3 to 4 |

[a]600 denier Nextel 312 ceramic fiber, an alumina-boria-silica fiber
[b]Nextel 17B ceramic fiber, a thoria-silica fiber
[c]Nextel Z-11 ceramic fiber, a zirconia-silica ceramic fiber
[d]"50 rayon" means 50 denier rayon yarn; "40 nylon"means 40 denier nylon yarn
[e]Twisted and plied, then double served with 50 denier rayon with 7–8 wraps per cm
[f]"D" means double and "S"means single serving
[g]Q-18 is Astroquartz fused silica fibers, a plied sewing thread
[h]MST-39 is composite Nextel 312 ceramic fiber sewing thread of braided construction

TABLE II

PHYSICAL PROPERTIES OF CERAMIC THREAD[b]

| Sample | Diameter (mm) | Yarn Breaking (kg) Strength | H.C.[a] | Knot (kg) Strength | H.C.[a] | Thread strength after abrasion test (40 CYCLES), kg |
|---|---|---|---|---|---|---|
| 1 | 0.74 | 11.3 | 4.1 | 2.3 | 1.4 | 1.9 |
| 2 | 0.86 | 10.0 | 4.1 | 4.4 | 1.3 | 4.1 |
| 3 | 0.81 | 12.0 | 5.4 | 3.4 | 1.6 | 3.9 |
| 4 | 0.68 | 8.0 | 3.9 | 1.1 | 0.45 | — |
| 5 | 0.74 | 9.6 | 5.4 | 2.5 | 1.1 | 1.9 |
| 6 | 0.86 | 9.5 | 4.3 | 4.2 | 1.4 | — |
| 7 | 0.86 | 12.4 | 4.0 | 3.8 | 1.7 | 3.5 |
| 8 | 0.81 | 11.1 | 4.3 | 4.1 | 1.3 | 1.9 |
| 9 | 1.06 | 17.2 | 7.3 | 6.4 | 2.8 | — |
| 10 | 1.09 | 8.6 | 6.3 | 3.8 | 2.6 | — |
| 11 | 0.56 | 5.0 | 2.4 | 0.45 | 0.11 | — |

TABLE II-continued

PHYSICAL PROPERTIES OF CERAMIC THREAD[b]

| Sample | Diameter (mm) | Yarn Breaking (kg) Strength | H.C.[a] | Knot (kg) Strength | H.C.[a] | Thread strength after abrasion test (40 CYCLES), kg |
|---|---|---|---|---|---|---|
| 12 | 0.76 | 10.8 | 4.9 | 2.40 | 1.6 | — |
| 13 | 0.51 | 6.3 | 1.0 | 3.4 | 0.11 | — |
| 14 | 0.99 | 15.5 | 4.2 | 4.8 | 0.72 | — |

[a]H.C. means heat cleaned at 800° C. for 15 minutes
[b]Values represent average of three or more test specimens

TABLE III

Sewability Tests on Blanket

| | Sewability Test Results |
|---|---|
| Sample 1 | Thread broke at slow machine speed. |
| Sample 2 | Thread sewed well but broke at low-medium speeds. Some damage to thread after sewing. |
| Sample 3 | Sewed very well. Broke only at near-maximum machine speed. This thread is the preferred sample. |
| Sample 4 | Broke at slow speeds. |
| Sample 5 | Broke at slow-medium speeds. Some damage. |

TABLE IV

SEAM BREAKING STRENGTHS[a] (kg) AFTER HEAT TREATMENT AT:

| Thread sample used | 1 hr 670° C. | 1 hr 670° C. + 1 hr 890° C. | 1 hr 670° C. + 1 hr 1050° C. | 1 hr 670° C. + 1 hr 1250° C. |
|---|---|---|---|---|
| Sample 2 | 15.0 | 11.6 | 9.3 | 3.3 |
| Sample 3 | 13.1 | 15.2 | 9.3 | 3.4 |
| Sample 4 | 6.8 | 5.4 | 8.2 | 3.6 |
| Sample 5 | 8.6 | 10.4 | 8.8 | 3.4 |
| Sample 13 | 4.1 | 4.1 | 0.95 | 1.6 |
| Sample 14 | 3.1 | 2.7 | 2.5 | 1.95 |

[a]Evaluated at room temperature according to ASTM D1683-68: sample width 10.1 cm; jaw separation 6.35 cm; crosshead rate .51 cm/min.; chart rate 1.25 cm/min.; values in table are in kg; all samples were 1.8 stitches per cm; type 301 lockstitch Various modifications and alterations of this invention will become apparent to those skilled in the art without departing from the scope and spirit of this invention, and it should be understood that this invention is not to be unduly limited to the illustrative embodiments set forth herein.

I claim:

1. A sewing thread comprising:

at least two strands of continuous non-vitreous ceramic fibers selected from the class consisting of graphite-containing, silicon carbide-containing, and ceramic metal oxide-containing fibers, at least one of which strands is served with organic or inorganic yarn, said strands being twisted in one direction, and an assembly of the resulting twisted strands plied with other strands of non-vitreous continuous ceramic fibers selected from the class consisting of graphite-containing, silicon carbide-containing, and ceramic metal oxide-containing fibers in the opposite direction to form a thread.

2. The sewing thread according to claim 1 wherein said ceramic fibers are non-vitreous ceramic fibers.

3. The sewing thread according to claim 1 wherein said ceramic fibers are selected from fused silica, silicon carbide, alumina-silica, thoria-silica-metal (III) oxide, zirconia-silica, alumina-chromia-metal (IV) oxide, titania, and alumina-boria-silica fibers, or blends thereof.

4. The sewing thread according to claim 1 wherein said strands each have a number of fibers in the range of 25 to 1000 and a denier on the range of 50 to 1800.

5. The sewing thread according to claim 1 having 2 to 12 strands.

6. The sewing thread according to claim 1 the integrity of which is maintained up to 1150° C.

7. The sewing thread according to claim 1 the integrity of which is mintained up to 1500° C.

8. The sewing thread according to claim 1 wherein said ceramic fibers are alumina-boria-silica fibers.

9. The sewing thread according to claim 1 wherein the material used for serving is selected from organic and inorganic yarn or blends thereof.

10. The sewing thread according to claim 9 wherein the material used for serving is selected from twisted or untwisted rayon, polyester, polyamide, elastomeric, cotton yarn or blends thereof.

11. The sewing thread according to claim 9 wherein the material used for serving is inorganic yarn selected from fibers of refractory metal and fused silica fibers.

12. The sewing thread according to claim 9 wherein the serving yarn has a denier in the range of 30 to 300.

13. The sewing thread according to claim 9 wherein said serving yarn is 50 denier rayon.

14. The sewing thread according to claim 1 wherein said serving yarn is heat fugitive.

15. The sewing thread according to claim 1 which is served as a whole with yarn of fiber selected from organic and inorganic fibers or blends thereof.

16. A sewing thread comprising:

two strands of continuous ceramic fibers, each of said strands having a number of filaments in the range of 130 to 500 and a fiber denier in the range of 400 to 900, and said strands being individually served with 50 denier rayon, said served strands being twisted, and said twisted strands being aggregated and plied with three other like twisted strands to form a 2/4 sewing thread.

17. The sewing thread according to claims 1 or 16 wherein said ceramic fibers are alumina-boria-silica fibers having an alumina:boria mol ratio of 9:2 to 3:1.5, and containing up to 65 weight percent silica.

18. The sewing thread according to claims 1 or 16 wherein said ceramic fibers are alumina-silica fibers having an alumina to silica ratio of 3:2.

19. A high temperature resistant article sewn with the sewing thread according to claim 1.

20. A high temperature resistant fabric article sewn with the sewing thread according to claim 1.

21. The sewing thread according to claim 1 wherein said strands of ceramic fibers are individually twisted in one direction.

22. The sewing thread according to claim 21 wherein said individually twisted strands are served again with organic or inorganic yarn.

23. The sewing thread according to claim 1 wherein said strands of ceramic fibers are twisted together in one direction.

24. The sewing thread according to claim 23 wherein said twisted together strands are served again with organic or inorganic yarn.

25. The sewing thread according to claim 1 wherein said assembly of resulting twisted strands are plied with other like twisted strands of continuous ceramic fibers.

26. The sewing thread according to claim 1 wherein said assembly of resulting twisted strands are plied with other different twisted strands of continuous fibers.

27. A sewing thread comprising at least one twisted strand of continuous non-vitreous ceramic fibers selected from the class consisting of graphite-containing, silicon carbide-containing, and ceramic metal oxide-containing fibers, said twisted strand being served with an organic or inorganic yarn, the integrity of said thread being capable of being maintained up to a temperature of 1500° C.

28. A sewing thread comprising:

at least two strands of continuous non-vitreous ceramic fibers, each of said strands having a number of filaments in the range of 130 to 500 and a fiber denier in the range of 400 to 900, and said strands being served with organic or inorganic yarn having a fiber denier in the range of 30 to 300, said served strands being twisted, and said twisted strands being aggregated and plied with other served, twisted strands of continuous, ceramic metal oxide-containing fibers in the opposite direction to form a thread.

29. A sewing thread comprising:

at least two strands of continuous non-vitreous ceramic fibers selected from the class consisting of ceramic metal oxide-containing fibers, at least one of which strands is served with organic or inorganic yarn, said strands being twisted in one direction, and an assembly of the resulting twisted strands plied with other strands of non-vitreous continuous ceramic fibers selected from the class consisting of ceramic metal oxide-containing fibers in the opposite direction to form a thread.

30. A sewing thread comprising at least one twisted strand of continuous non-vitreous ceramic fibers selected from the class consisting of ceramic metal oxide-containing fibers, said twisted strand being served with an organic or inorganic yarn, the integrity of said thread being capable of being maintained up to a temperature of 1500° C.

* * * * *

UNITED STATES PATENT AND TRADEMARK OFFICE

CERTIFICATE OF CORRECTION

PATENT NO. : 4,430,851

DATED : February 14, 1984

INVENTOR(S) : Douglas C. Sundet

It is certified that error appears in the above-identified patent and that said Letters Patent is hereby corrected as shown below:

Column 9, line 68 in Claim 3, delete "fused silica,"

Signed and Sealed this

*Fifth* Day of *November 1985*

[SEAL]

*Attest:*

*Attesting Officer*

DONALD J. QUIGG

*Commissioner of Patents and Trademarks*